US012419434B2

(12) United States Patent
Wickett

(10) Patent No.: US 12,419,434 B2
(45) Date of Patent: Sep. 23, 2025

(54) CUSHIONING MATERIAL

(71) Applicant: DAVIDHUGH LIMITED, Cambridge (GB)

(72) Inventor: David Hugh Wickett, Cambridge (GB)

(73) Assignee: DAVIDHUGH LIMITED, Cambridge (GB)

( * ) Notice: Subject to any disclaimer, the term of this patent is extended or adjusted under 35 U.S.C. 154(b) by 0 days.

(21) Appl. No.: 17/766,584

(22) PCT Filed: Oct. 12, 2020

(86) PCT No.: PCT/GB2020/052540
§ 371 (c)(1),
(2) Date: Apr. 5, 2022

(87) PCT Pub. No.: WO2021/074601
PCT Pub. Date: Apr. 22, 2021

(65) Prior Publication Data

US 2024/0099474 A1 Mar. 28, 2024

(30) Foreign Application Priority Data

Oct. 13, 2019 (GB) ..... 1914794

(51) Int. Cl.
*A47C 27/045* (2006.01)
*A47C 23/00* (2006.01)
(Continued)

(52) U.S. Cl.
CPC ..... *A47C 27/045* (2013.01); *A47C 23/002* (2013.01); *A47C 23/043* (2013.01);
(Continued)

(58) Field of Classification Search
CPC ... A47C 27/045; A47C 23/002; A47C 23/043; A47C 27/064; A47C 27/16; A47C 27/20
(Continued)

(56) References Cited

U.S. PATENT DOCUMENTS 1,269,018 A * 6/1918 Stevens ..... A47C 27/064 5/655.8
3,633,228 A * 1/1972 Zysman ..... A47C 7/20 267/143
(Continued)

FOREIGN PATENT DOCUMENTS

CN 202112706 U 1/2012
CN 107427134 12/2017
(Continued)

OTHER PUBLICATIONS

Combined Search and Examination Report issued in Appl. No. GB1914794.1 (2021).
(Continued)

*Primary Examiner* — Justin C Mikowski
*Assistant Examiner* — Luke Hall
(74) *Attorney, Agent, or Firm* — Barnes & Thornburg LLP

(57) ABSTRACT

Cushioning material comprising a microcoil sheet and a surface cover material, the microcoil sheet comprising an array of wire springs held between two layers of fabric, the layers of fabric being joined together to form discrete spring-containing pockets; wherein the cover material is fastened to the microcoil sheet by one or more seams. Also provided is a cushioned or upholstered article (such as a mattress, mattress topper, seat, chair or loose cushion) comprising cushioning material according to any preceding claim. Also provided is a method of manufacturing cushioning material comprising a microcoil sheet and a surface cover material, the microcoil sheet comprising an array of wire springs held between two layers of fabric, the layers of fabric having been joined together to form discrete spring-containing pockets; the method comprising fastening the cover material to the microcoil sheet by one or more seams.

16 Claims, 10 Drawing Sheets

(51) Int. Cl.

| | |
|---|---|
| ***A47C 23/043*** | (2006.01) |
| ***A47C 27/06*** | (2006.01) |
| ***A47C 27/16*** | (2006.01) |
| ***A47C 27/20*** | (2006.01) |

(52) U.S. Cl.
CPC ..... *A47C 27/064* (2013.01); *A47C 27/16* (2013.01); *A47C 27/20* (2013.01)

(58) Field of Classification Search
USPC ..... 5/718
See application file for complete search history.

(56) References Cited

U.S. PATENT DOCUMENTS

| | | | | |
|---|---|---|---|---|
| 3,719,963 | A * | 3/1973 | Bullock, Jr. | A47C 27/20 264/46.7 |
| 4,429,427 | A * | 2/1984 | Sklar | A47C 27/20 5/655.9 |
| 4,907,309 | A * | 3/1990 | Breckle | A47C 27/063 5/718 |
| 5,040,255 | A * | 8/1991 | Barber, Jr. | A47C 27/063 5/718 |
| 8,800,082 | B2 * | 8/2014 | Kluft | A47C 27/056 5/717 |
| 9,635,952 | B1 * | 5/2017 | Anthony | A47C 27/121 |
| 10,188,219 | B2 | 1/2019 | Codos | |
| 11,793,322 | B2 | 10/2023 | Pearce | |
| 2008/0184492 | A1 * | 8/2008 | Sunde | A47C 27/144 5/717 |
| 2009/0133195 | A1 * | 5/2009 | Elzenbeck | A47C 27/20 5/718 |
| 2014/0373280 | A1 * | 12/2014 | Mossbeck | A47C 27/064 5/718 |
| 2015/0342362 | A1 * | 12/2015 | DeMoss | A47C 27/20 5/718 |
| 2016/0235213 | A1 | 8/2016 | Long | |
| 2017/0360213 | A1 * | 12/2017 | Susever | B21F 27/16 |
| 2018/0140105 | A1 | 5/2018 | Spinks | |
| 2019/0142179 | A1 * | 5/2019 | Hegg | A47C 27/064 5/720 |
| 2019/0387896 | A1 * | 12/2019 | Lisenbee | A47C 27/05 |

FOREIGN PATENT DOCUMENTS

| | | |
|---|---|---|
| CN | 107809929 | 3/2018 |
| CN | 108778063 | 11/2018 |
| CN | 208803241 U | 4/2019 |
| EP | 0578035 | 6/1993 |
| GB | 2567413 | 8/2017 |
| GB | 2547336 | 4/2019 |
| WO | 2016/149302 | 9/2016 |
| WO | 2016/174446 | 11/2016 |
| WO | 2017/155819 | 9/2017 |
| WO | 2018/125153 | 7/2018 |
| WO | 2018/220366 | 12/2018 |
| WO | 2019/034850 | 2/2019 |
| WO | 2020/005425 | 1/2020 |

OTHER PUBLICATIONS

Search Report and Written Opinion issued in Appl. No. PCT/GB2020/052540 (2021).
Search Report issued in Appl. No. CN2020800714503 (Nov. 21, 2023).
Search Report for CN 2020800714503 dated Nov. 16, 2023.
Search Report for CN 2020800714503 dated May 17, 2024.
Search Report for CN 2020800714503 dated Dec. 23, 2024.
Examination Report dated Dec. 25, 2024 for related CN 202070071450.3

* cited by examiner

CUSHIONING MATERIAL

CROSS-REFERENCE TO RELATED APPLICATIONS

This application is a US nationalization application under 35 USC § 371 of PCT Application No. PCT/GB2020/052540, filed on Oct. 12, 2020, which claims priority from United Kingdom Patent Application No. GB 1914794.1, filed on Oct. 13, 2019, the entirety of which are each fully incorporated by reference herein.

FIELD OF THE INVENTION

This invention relates to cushioning material, and, more particularly, to microcoil-based cushioning material. It is particularly applicable, but by no means limited, for use in mattresses and mattress toppers, and seat/chair cushions (which may be fixed to a seat or chair, or loose). Applications in other types of cushioned or upholstered articles, and weighted blankets, are also possible.

Background to the Invention

With reference initially to FIG. 1, a mattress 10 or seat cushion generally consists of two main elements: a comfort layer 11 and a support core 16. It should be understood that, in some mattresses or cushions, more than one such comfort layer 11 may be provided. For the sake of simplicity, the present disclosure will refer to mattresses or cushions having a single comfort layer 11, but it should be understood that the present principles may be directly extended to mattresses or cushions or other articles having multiple comfort layers 11. References herein to "cushions" should be understood as applying to any type of upholstery, as well as to loose cushions, and to cushions that are fixed to a chair or seat.

Certain mattresses and cushions use, or could use, microcoil arrays 14 in the comfort layer 11. As shown in FIG. 2, a microcoil array 14 (as known from the prior art) is a two-dimensional array of relatively small metal wire springs 17 (each of the order of 2-5 cm in diameter) held between two layers of fabric (typically synthetic fabric) that are welded together along seams 18 to create discrete pockets 19 that house the springs 17. Such a microcoil array 14 may also be referred to as a "microcoil sheet" or "sheet of microcoils". The present diagrams primarily illustrate microcoil arrays in cross-section (and thus they may at first glance appear one-dimensional) but those skilled in the art will naturally appreciate that the microcoil arrays are two-dimensional (n×m) arrays, where n and m are typically many tens or hundreds in number. Accordingly, depending on its overall size, a microcoil array 14 may comprise hundreds or thousands of individual wire springs 17.

As shown in FIG. 1, which illustrates a typical construction of a microcoil mattress 10, a microcoil sheet 14 may be employed in the comfort layer 11 of the mattress 10, sandwiched between two transitional layers 13, 15 of cushioning material such as polyurethane foam, memory foam, latex or natural fibres. Over this there is typically a sewn quilted cover 12.

Microcoils are not presently known to be used in manufactured seating although they are marketed for use in this application.

The present inventor has identified that the potential for microcoils to provide comfort lies in their ability to move independently in compression and from side to side. FIG. 3 depicts a single wire microcoil spring 17, and illustrates that it can pivot from side to side in x and y directions (or a combination thereof) and/or can resiliently compress or extend in the z direction. Accordingly, if a person were to sit or lie directly on a sheet of microcoils, each spring would respond independently to the part of the body it contacts, without affecting neighbouring springs. This is an important characteristic of microcoil sheets. However, the ability of microcoil springs to move independently is compromised when additional sheets of materials (including a cover) are placed on top or stretched over the springs, which is how they are presently constructed in mattresses.

Another important feature of microcoils is the pressure variation that exists between the areas over the wires and the areas between the wires. This pressure variation may aid blood perfusion in the skin. It may also contribute to the positive sensation experienced when sitting or lying directly on a sheet of microcoils. However, this pressure variation diminishes when sheets of material are placed over the microcoils.

The present inventor has found that, when combined with a suitable support core, a sheet of microcoils can significantly reduce interface pressure, which is an important parameter for comfort and for reducing risk of tissue damage in long term lying or sitting. To illustrate this, FIG. 4*a* shows a pressure map of an individual's buttocks sitting directly on a 90 mm thick high resilient foam cushion with no cover, and FIG. 4*b* shows the resulting pressure map with a microcoil sheet added at the interface between the individual and the foam cushion. In this example, the microcoils reduced the Peak Pressure Index (the highest average pressure measured in a 9 $cm^2$ area) by 40%. This shows the potential for microcoils to reduce interface pressure, but only if they are employed high in the comfort layer to interface with the cover and constructed in a way that allows the springs to respond and move independently.

However, a problem with employing microcoils high in the comfort layer (i.e. towards the top of the comfort layer, close to where the user contacts it) is that, generally, it is not visually acceptable, and is therefore not perceived as a viable commercial option in mattress or seat cushion design.

An aim of the present invention is, therefore, to enable the microcoils to be employed high in the comfort layer, to provide a cover that does not inhibit independent movement of the springs, and to do this in a way that is visually acceptable and commercially viable.

SUMMARY OF THE INVENTION

Aspects of the invention are set out in the appended independent claims, while details of particular embodiments are set out in the appended dependent claims.

According to a first aspect of the invention there is provided cushioning material comprising a microcoil sheet and a surface cover material, the microcoil sheet comprising an array of wire springs held between two layers of fabric, the layers of fabric being joined together to form discrete spring-containing pockets; wherein the cover material is fastened to the microcoil sheet by one or more seams. More particularly, the cover material is fastened to the fabric of the microcoil sheet, between the springs themselves—e.g. along inherent weld lines of the microcoil sheet.

Such a structure advantageously enables the microcoils to be positioned closely below the outwardly-visible user-contactable surface provided by the cover material, and allows independent movement of the springs, whilst also being visually acceptable.

Attaching the surface cover material to the microcoil sheet in such a manner may also result in an improvement in the strength and durability of the overall structure (including the strength and durability of the microcoil sheet itself).

In certain embodiments the seams may run continuously across the cushioning material. This may be used to give the cushioning material a fluted appearance.

In other embodiments the seams may be discontinuous across the cushioning material.

In presently-preferred embodiments the seams coincide with inherent weld lines of the microcoil sheet, the weld lines joining said layers of fabric together. In the case of discontinuous seams, the seams may be in the form of cross stiches coinciding with intersections of the weld lines of the microcoil sheet.

By passing the seams through the microcoil sheet, along the inherent weld lines, this strengthens the inherent weld lines of the microcoil sheet, and thus improves the strength and durability of the microcoil sheet and the overall structure.

In certain embodiments the cover material may be directly in contact with the microcoil sheet (i.e. with no interlayer material between them). Alternatively, the cushioning material may comprise one or more interlayer materials between the cover material and the microcoil sheet, for example to provide additional cushioning or fire retardancy.

In certain embodiments the seams may be formed by stitching, the stitching passing through the cover material and the microcoil sheet. In the event of interlayer material between the cover material and the microcoil sheet, the stitching may also pass through the interlayer material; the microcoil sheet and the cover material are nevertheless still fastened to one another by the seams.

In other embodiments the interlayer material may be arranged in discrete regions between the seams.

In presently-preferred embodiments the stitching is machine needle-and-thread stitching.

As an alternative to stitching, the seams may for example be formed by welding.

The seams may define, in the cover material, pockets that separate individual springs or groups of springs, or elongate flutes that separate groups of springs.

According to a second aspect of the invention there is provided a cushioning structure comprising a first piece of cushioning material according to the first aspect of the invention, attached by means of a further seam to a second piece of cushioning material according to the first aspect of the invention.

If the first and second pieces of cushioning material comprise elongate flutes, the elongate flutes of the first piece of cushioning material may for example be oriented parallel or perpendicularly to the elongate flutes of the second piece of cushioning material.

Optionally, to suit the desired end product, the surface cover material and/or microcoil sheet of the first piece of cushioning material may be different from the surface cover material and/or microcoil sheet of the second piece of cushioning material.

In certain embodiments the further seam may be along only one edge of the first and second pieces of cushioning material.

In other embodiments the further seam may be along at least two edges (and preferably along at least three edges) of the first and second pieces of cushioning material, the first and second pieces of cushioning material overlaying one another. To provide a high level of cushioning, the microcoil sheet of the first piece of cushioning material may face towards the microcoil sheet of the second piece of cushioning material.

Optionally the cushioning structure may further comprise an insert between the microcoil sheet of the first piece of cushioning material and the microcoil sheet of the second piece of cushioning material, the insert comprising one or more of:

- sheet foam or moulded foam;
- a rigid or semi-rigid former;
- one or more structural members that form part of the structure of an item of furniture;
- heating elements, or vibration or massage elements;
- one or more fixing structures or mounts; or another microcoil sheet.

According to a third aspect of the invention there is provided a cushioned or upholstered article comprising cushioning material according to the first aspect of the invention or a cushioning structure according to the second aspect of the invention.

In the case of the article being a mattress, the cushioning material or cushioning structure may be attached to a mattress support core.

Alternatively, the article may be, for example, a mattress topper, a weighted blanket, a seat or chair, or a standalone cushion.

According to a fourth aspect of the invention there is provided a method of manufacturing cushioning material comprising a microcoil sheet and a surface cover material, the microcoil sheet comprising an array of wire springs held between two layers of fabric, the layers of fabric having been joined together to form discrete spring-containing pockets; the method comprising fastening the cover material to the microcoil sheet (specifically, to the fabric thereof) by one or more seams.

In a certain embodiment, when forming each seam, the cover material is first folded shortly after the intended position of the seam to form a double-layer of the cover material, then said double-layer of the cover material is fastened to the microcoil sheet to form the seam, and then the cover material is unfolded and pulled over a group of springs before the next seam is formed. This advantageously results in the seams being hidden from view in the final product.

In further embodiments, first and second pieces of the cushioning material may be joined together by means of a further seam.

For instance, the further seam may be along at least two edges (and preferably along at least three edges) of the first and second pieces of cushioning material, the first and second pieces of cushioning material overlaying one another. Furthermore, an opening may be provided in the further seam, and the first and second pieces of cushioning material may initially be attached by the further seam such that the microcoil sheets of the first and second pieces of cushioning material face away from one another, thereby forming an intermediate product. Then, the method may further comprise turning the intermediate product inside-out, through said opening, to result in the microcoil sheets of the first and second pieces of cushioning material facing towards one another. In such a manner, an enclosed cushioning structure may be produced that is able to provide a high level of pressure relief to the user.

BRIEF DESCRIPTION OF THE DRAWINGS

Embodiments of the invention will now be described, by way of example only, and with reference to the drawings in which.

In the figures, like elements are indicated by like reference signs throughout.

DETAILED DESCRIPTION OF PREFERRED EMBODIMENTS

The present embodiments represent the best ways known to the Applicant of putting the invention into practice. However, they are not the only ways in which this can be achieved.

Figure 1:
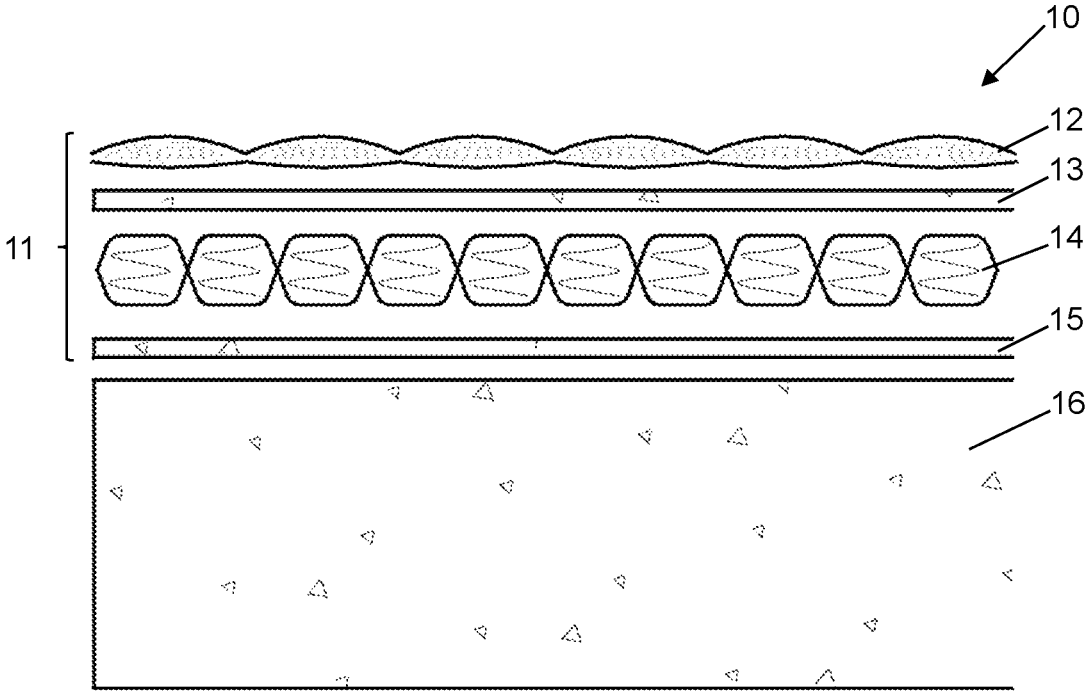
FIG. 1 illustrates a cross-sectional side view of a typical microcoil mattress construction.
Figure 2:
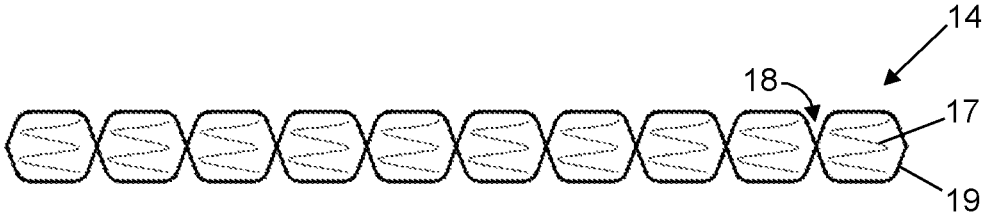
FIG. 2 illustrates a cross-sectional side view of a typical microcoil array.
Figure 3:
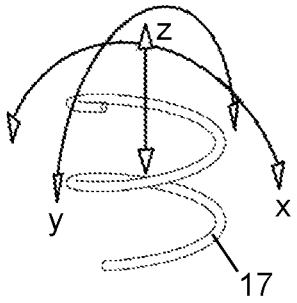
FIG. 3 illustrates typical degrees of movement of an independent microcoil spring.
Figure 4A:
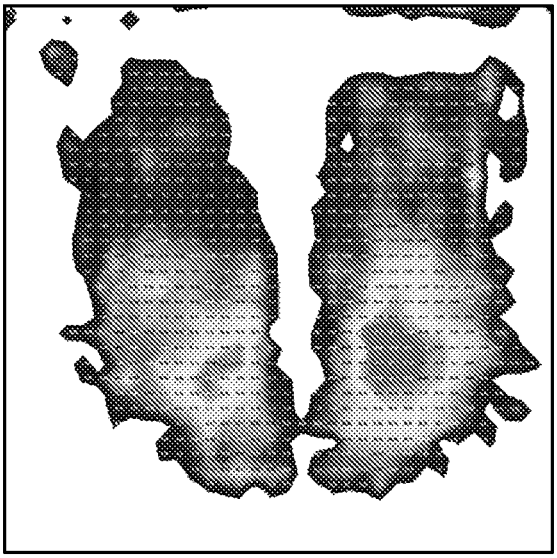
FIG. 4*a* is a pressure map of an individual's buttocks sitting directly on a foam cushion.
Figure 4B:
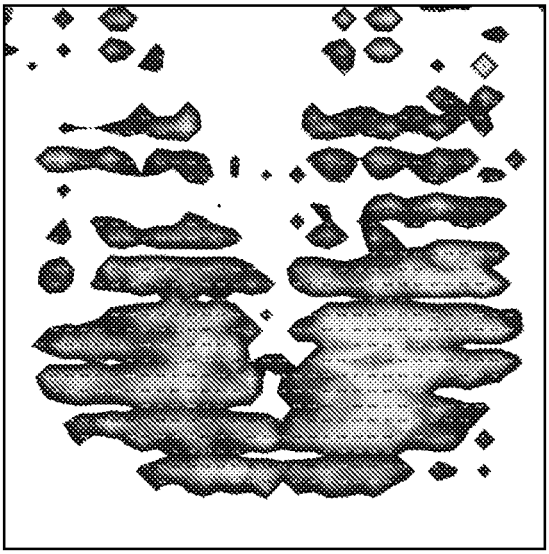
FIG. 4*b* is a pressure map under the same conditions as for FIG. 4*a* but with a microcoil sheet added at the interface between the individual and the foam cushion.
Figure 5:
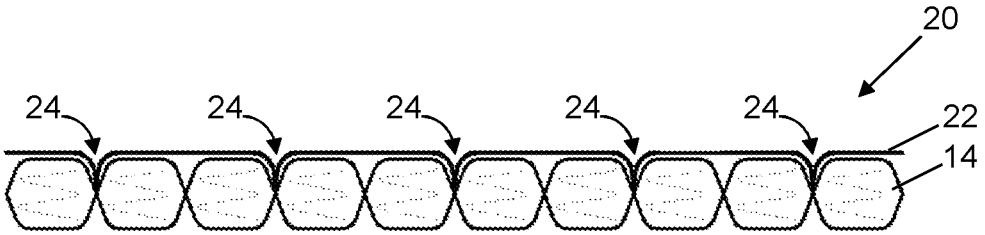
FIG. 5 illustrates a cross-sectional side view of an embodiment of a microcoil-based cushioning material comprising a microcoil sheet to which a surface cover material is attached.

As illustrated in FIG. 5, embodiments of the present invention provide a microcoil-based cushioning material 20 (e.g. for upholstery or a mattress) wherein a surface cover material 22 (that may be outwardly visible to a user and contacted by a user in use) is attached to a microcoil sheet 14, e.g. by sewing or welding, such that the cover material 22 and the microcoil sheet 14 are fastened to one another by seams (i.e. join lines) 24.

The seams 24 may run continuously across the cushioning material 20, or may be discontinuous (e.g. in discrete places only).

The cover material 22 may be directly in contact with the microcoil sheet 14 (i.e. with no interlayer material between them). Alternatively, in some variants, one or more interlayer materials may be provided between the microcoil sheet 14 and the cover material 22 to provide, for example, additional cushioning or fire retardancy. However, even when one or more interlayer materials are provided between the microcoil sheet 14 and the cover material 22, the microcoil sheet 14 and the cover material 22 are nevertheless still fastened to one another by the seams 24—e.g. by stitching that passes through the microcoil sheet 14, through the interlayer material(s), and through the cover material 22; or by the interlayer material(s) being arranged in discrete regions between the seams 24, such that the seams 24 pass around the interlayer material(s).

In more detail, the present embodiments provide a new configuration of cushioning material 20 that interfaces microcoil pocket springs 14 with the cushion surface cover material 22, wherein the microcoil sheet 14 is fastened directly to the cover material 22 along seams 24 (e.g. by sewing or welding), and wherein zones are defined between the seams 24 that allow for independent movement of the constituent springs (of the microcoil sheet 14) within said zones.

The seams 24, along which the microcoil sheet 14 and the cover material 22 are fastened together, create either corresponding pockets or elongate flutes that separate individual springs or groups of springs. Merely by way of example, such a pocket may contain a single spring, or a 1×2, 2×2, 1×3, 2×3 or 3×3 group of springs. Naturally other numbers of springs are also possible within such a pocket. On the other hand, in a fluted arrangement (obtained using continuous seams), the flutes may separate continuous lines of springs that are a single spring wide, or two, three, four or more springs wide.

A typical commercially-available microcoil pocketed spring sheet 14 comprises two synthetic fabrics (of either the same or differing types) welded together by the manufacturer along seams, to create discrete spring-containing pockets. The present inventor has found that the size of such pockets (which is typically of the order of 2-4 cm×2-5 cm) is suitable to fit through a needle-and-thread sewing machine or a weld-seam sewing machine. Accordingly, this enables the cover material 22 to be stitched to the microcoil pocketed spring sheet 14 in parallel lines along the inherent pre-existing weld seams of the microcoil sheet 14. Alternatively, the cover material 22 may be stitched to the microcoil pocketed spring sheet 14 at the intersections of the inherent weld seams.

In presently-preferred embodiments the seams 24 are formed by a needle-and-thread sewing machine, by passing the microcoil sheet 14 and the cover material 22 together through the sewing machine, to form the seams 24 along the inherent pre-existing weld seams of the microcoil sheet 14, between adjacent rows of springs. That it is possible to pass a microcoil sheet, with its inherent metallic wire components, through such a sewing machine, was a surprising and counterintuitive finding on the part of the inventor, as such sewing machines are generally understood as being designed for sewing fabrics only, and the natural assumption would have been that the springs of the microcoil sheet 14 would risk catching, bending or breaking a sewing machine needle, or other delicate parts around the presser foot of the sewing machine.

Figure 6:
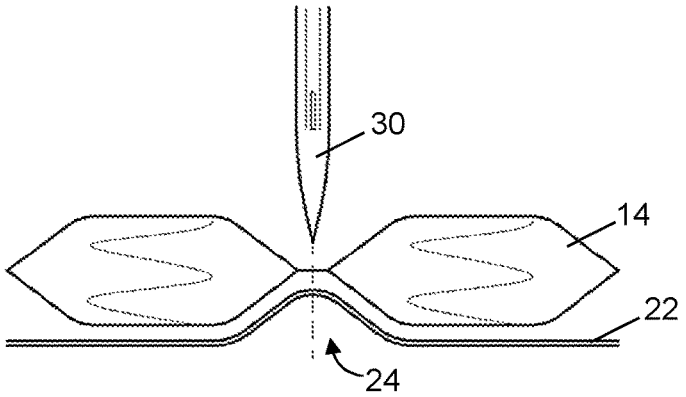
FIG. 6 illustrates, in cross-section, a sewing method for attaching a surface cover material to a microcoil sheet using vertical stitching.

FIG. 6 shows an example of the position and direction of the stitches with respect to the microcoil sheet 14, to attach the cover material 22 and form a seam 24 (the join line between the cover material 22 and the microcoil sheet 14). Here, the stitches are vertical, inserted using a needle 30 (e.g. of an industrial sewing machine) in parallel lines along the pre-existing weld seams of the microcoil sheet 14, between adjacent spring-containing pockets of the microcoil sheet 14.

Figure 7:
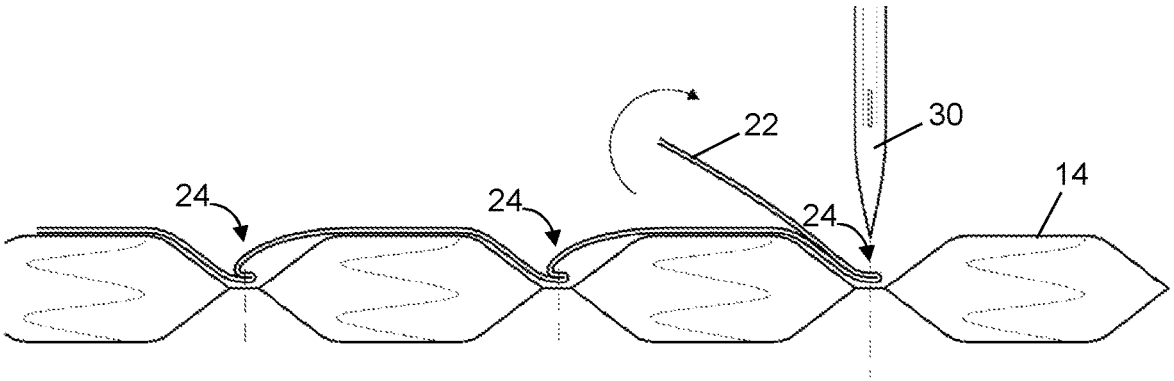
FIG. 7 illustrates, in cross-section, an alternative sewing method for attaching a surface cover material to a microcoil sheet using vertical stitching.

FIG. 7 illustrates an alternative sewing method to that of FIG. 6, for attaching the surface cover material 22 to the microcoil sheet 14, again using vertical stitching. In this case, though, before each seam 24 is stitched using the needle 30, the cover material 22 is folded back on itself as shown, shortly after the intended position of the seam 24, to form a local double-layer of the cover material 22. The stitching is then made through that local double-layer of the cover material 22 and the microcoil sheet 14 to form the seam 24. The cover material 22 is then unfolded and pulled over the next row (or multiple rows) of spring-containing pockets, and then folded back on itself ready to form the next seam 24. The stitching process is then repeated for that next seam 24, and so on. The advantage of this technique, compared to that of FIG. 6, is that in this case the seams 24 are hidden from view in the final product.

Figure 8:
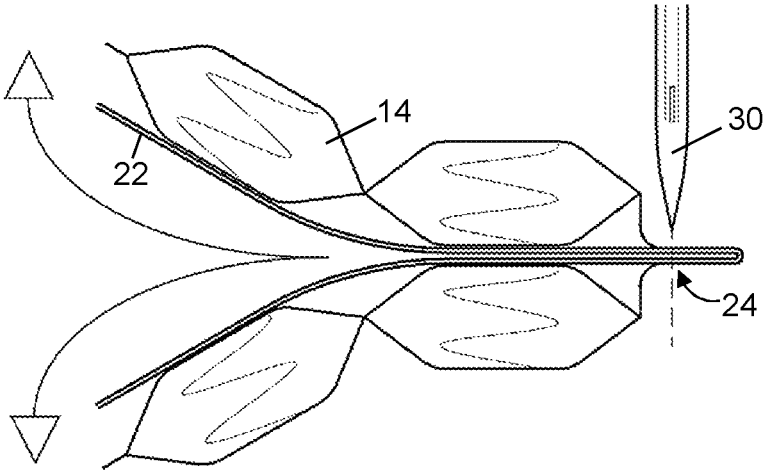
FIG. 8 illustrates, in cross-section, a sewing method for attaching a surface cover material to a microcoil sheet using horizontal stitching.

Alternatively, as shown in FIG. 8, the microcoil sheet 14 may be produced with rows of empty pockets to provide space for folding the microcoil sheet 14, to enable the stitches to be performed horizontally to form a seam 24. This technique also results in the seams 24 being hidden from view in the final product.

With the techniques of FIGS. 6, 7 and 8, the stitches may be created with a needle-and-thread sewing machine which allows for non-weldable cover materials, or alternatively the stitches may be welded if the cover material 22 is weldable to the microcoil sheet 14. Additional interlayer materials may be stitched between the microcoil sheet 14 and the cover material 22 to provide, for example, additional cushioning or fire retardancy. In such a case, the microcoil sheet 14 and the cover material 22 are nevertheless still fastened to one another, by the seam stitching that passes through the microcoil sheet 14, through the interlayer material(s), and through the cover material 22. Alternatively the interlayer material(s) may be arranged in discrete regions between the seams 24, such that the seams 24 pass around the interlayer material(s).

Sewn seams 24, passing through the microcoil sheet 14, have been found to significantly increase the strength and durability of the overall assembly (including the strength and durability of the microcoil sheet itself). This can be of particular importance if the assembly is to be at the extremity of a cushion or mattress, and not protected by a layer of foam or the like (which is the convention). This can be of even greater importance in a seat application where ingress and egress can add extra wear and tear. A car seat cushion, for example, needs to be significantly more durable than a bed mattress.

Figure 9:
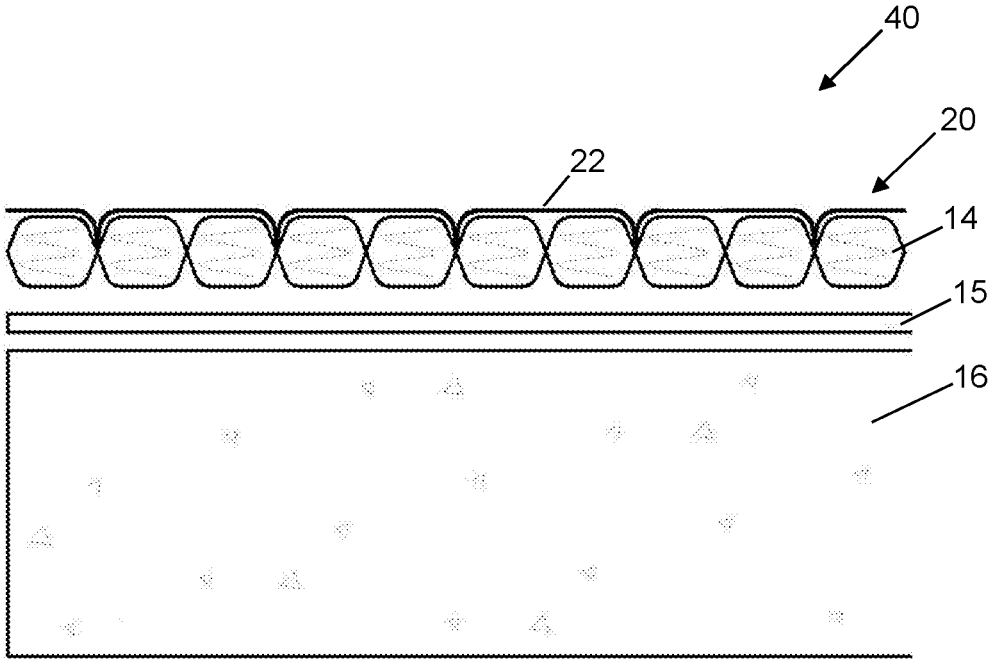
FIG. 9 illustrates a cross-sectional side view of a configuration of a microcoil mattress incorporating a microcoil-based cushioning material as in FIG. 5.

The above techniques may be used to manufacture cushioning material 20 for a range of purposes, wherein the surface cover material 22 and the microcoil sheet 14 are fastened to one another by seams 24. With reference to FIG. 9, in the case of the cushioning material 20 being for a mattress, the present cushioning material 20 may be fitted to a mattress support core 16 (optionally with a transitional layer 15 of cushioning material therebetween) in a conventional manner to create a new type of microcoil mattress 40. The support core 16 may, for example, be made from larger springs, memory foam, high resilience polyurethane foam, latex foam, natural fibres, or a combination thereof.

Exemplary Surface Designs

Figure 10:
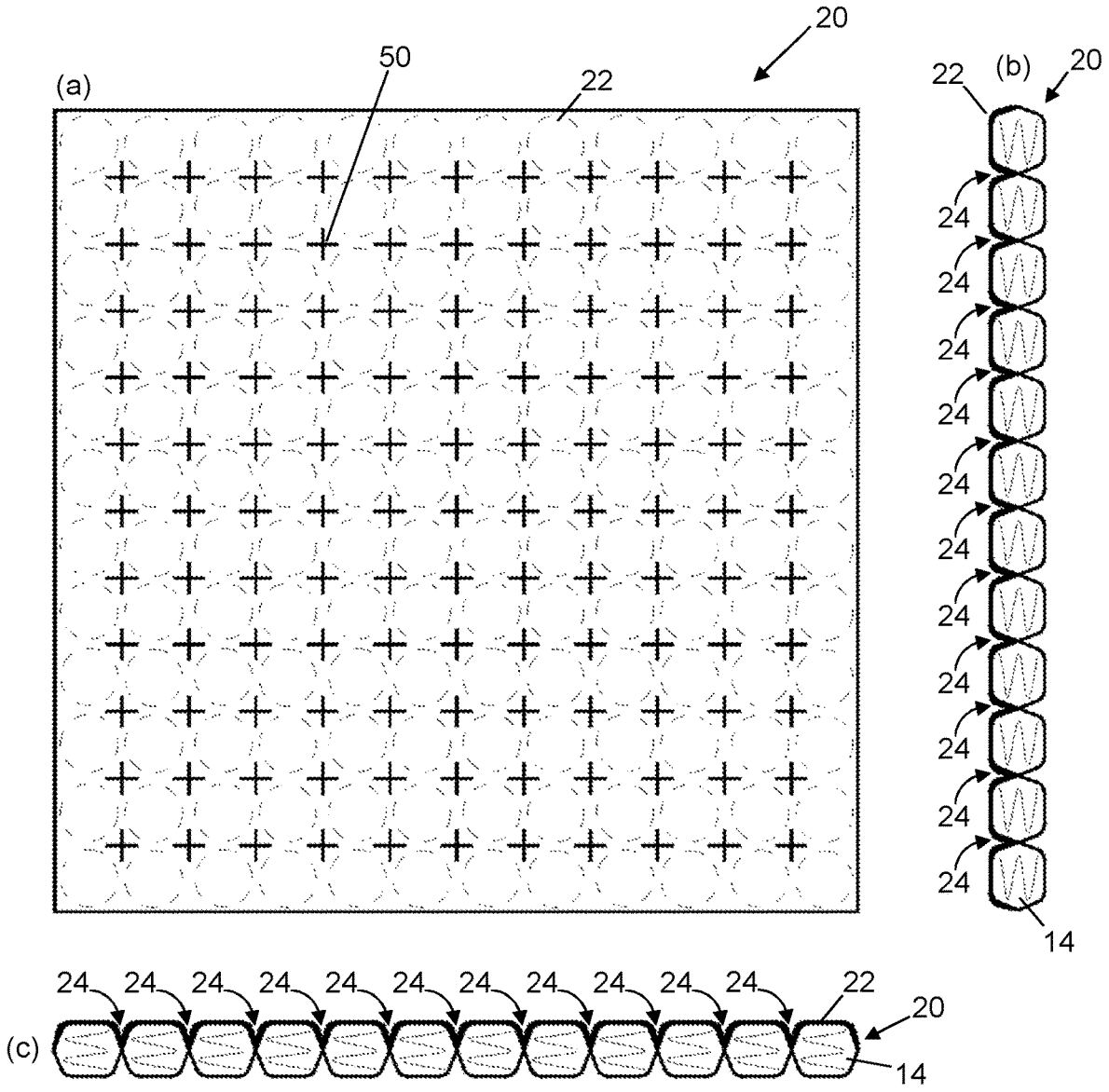
FIG. 10 illustrates a surface design of a microcoil-based cushioning material as in FIG. 5, where cross stitches (that attach the cover material to the microcoil sheet) are placed at the intersections of inherent weld lines in the microcoil sheet to create pockets.

FIG. 10 shows a surface design of an embodiment of the cushioning material 20 in (a) plan view, and (b)/(c) cross-sectional side views, where the seams 24 are discontinuous, in the form of cross stitches 50 that are applied only at the intersection of the welds in the microcoil sheet 14 to create corresponding pockets.

It will be appreciated that, in this example, the cross stitches 50 are at every intersection of the welds in the microcoil sheet 14, such that each pocket created contains a single microcoil spring. However, in variants of this design, the cross stiches may be less frequent—e.g. at every other intersection of the welds in the microcoil sheet 14, such that each pocket created contains four microcoil springs (in a 2×2 group).

Figure 11:
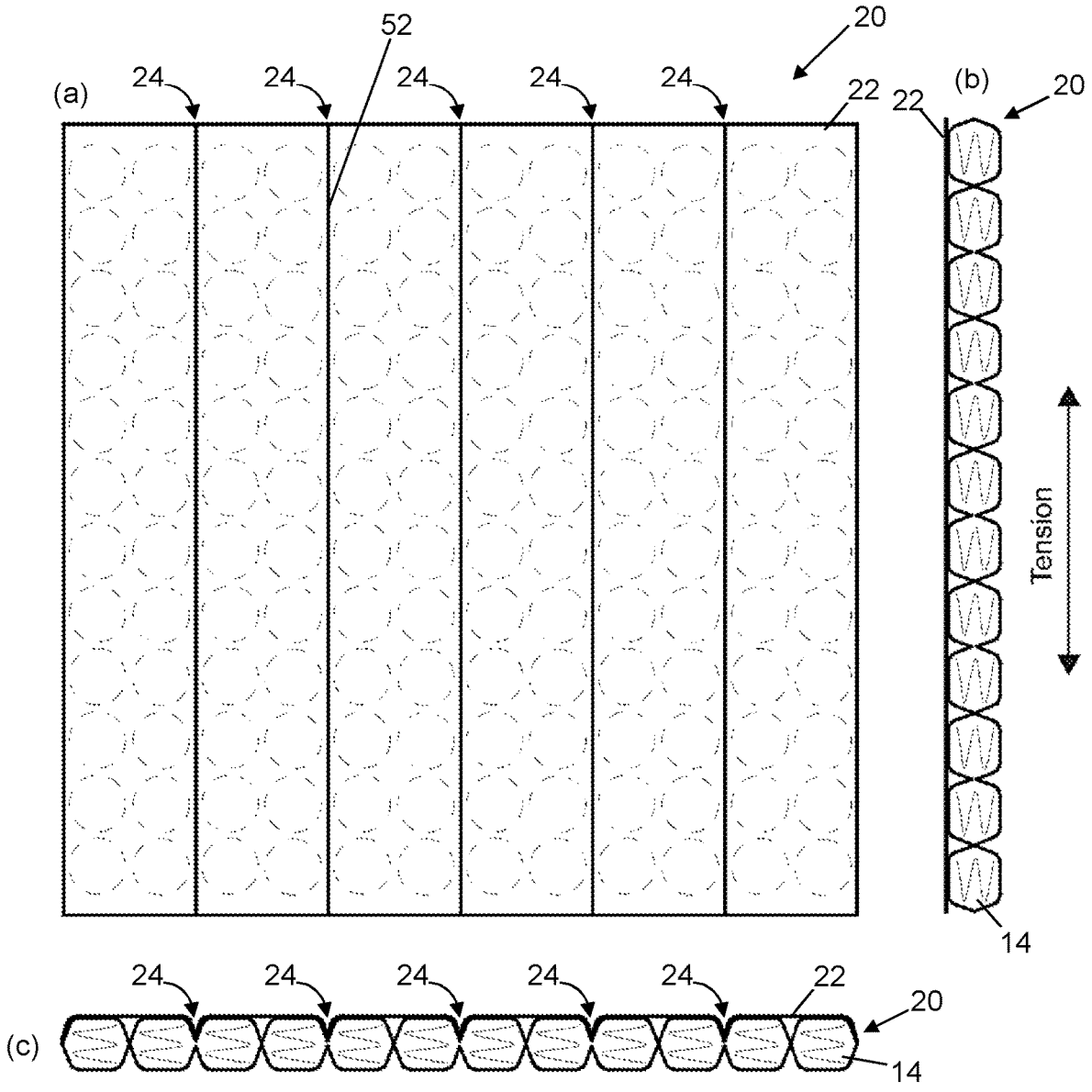
FIG. 11 illustrates a surface design of a microcoil-based cushioning material as in FIG. 5, where parallel seams (that attach the cover material to the microcoil sheet) are stitched along the inherent weld lines in the microcoil sheet to create flutes, and also showing that tension may be applied in the direction of the seams, e.g. if fitting to a support, to enhance the fluting.

FIG. 11 shows another surface design of an embodiment of the cushioning material 20 in (a) plan view, and (b)/(c) cross-sectional side views, in this case where parallel seams 24 are stitched along the weld seams in the microcoil sheet to create flutes 52. Such flutes may contain single rows of springs, or multiple rows of springs. In the example illustrated, the flutes contain two rows of springs, although other numbers are of course possible. Applying tension in the direction of the seams 24, as illustrated, may enhance the fluting effect—e.g. if the cushioning material 20 is to be fitted to a support.

Exemplary Applications

Embodiments of the invention are particularly applicable, but by no means limited, for use in mattresses and mattress toppers, and seat/chair cushions (which may be fixed to a seat or chair, or loose). Applications in other types of upholstery and cushioning are also possible. For instance, it is envisaged that embodiments may be used to form consumer mattresses, consumer mattress toppers, medical mattresses, medical mattress toppers, fixed seat/chair upholstery, loose seat/chair cushions, seat cushion toppers, weighted blankets, medical fixed seat/chair upholstery, medical loose seat/chair cushions, and medical seat cushions. Embodiments may also be used to provide cushioning in non-furniture items such as backpacks and infant carriers.

To provide additional explanation in respect of weighted blankets, in beds an objective of the present invention is to reduce interface pressure acting on the user's body from the mattress. Low pressure distribution is associated with improved sleep quality. Weighted blankets exist that claim to help with sleep disorders such as insomnia, and act by increasing pressure from the cover, thereby reducing the pressure differential on the whole of the user's body. Accordingly, a weighted blanket that embodies the present invention, that interfaces with the user using the same pressure redistributing technology as the mattress, would reduce the pressure differential on the user's body, homogenise the pressure distribution by using springs on all contact areas, and reduce any peak pressures that may otherwise exist in other weighted blankets.

Figure 12A:
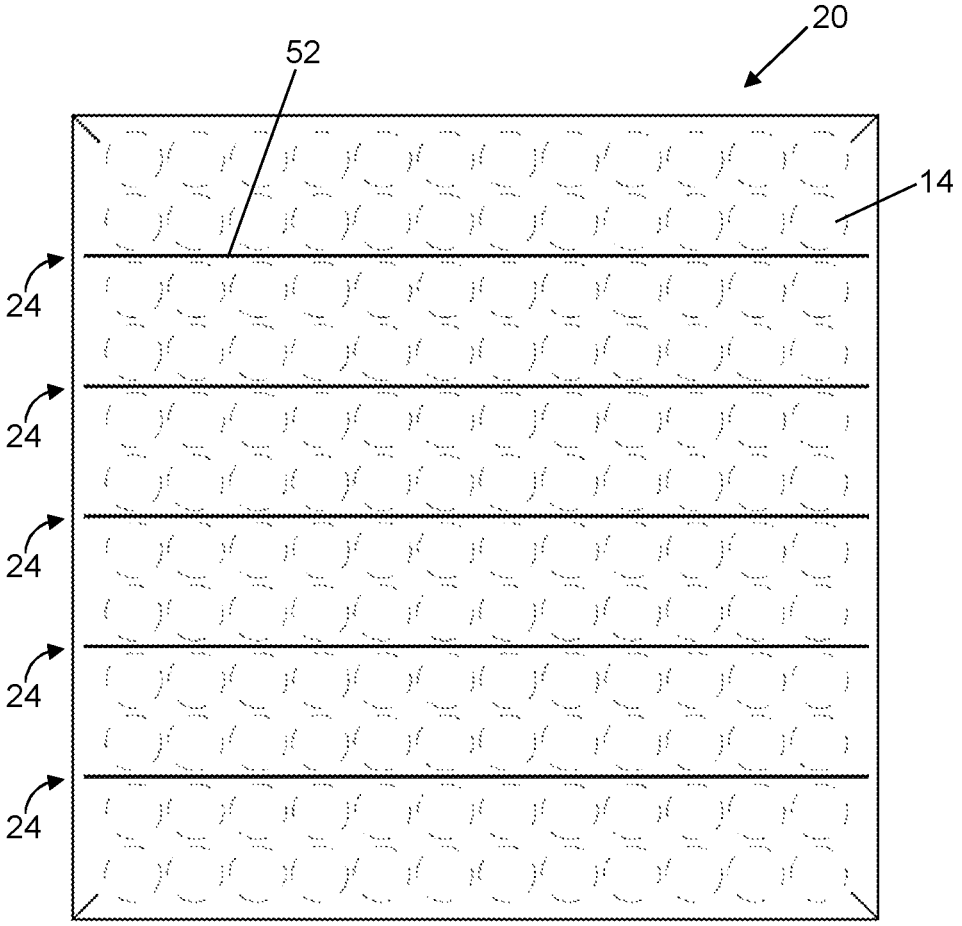
FIG. 12*a* illustrates a plan view of a fluted microcoil-based cushioning material substantially as in FIG. 11.

Another exemplary application in relation to upholstered furniture will now be described with reference to FIGS. 12*a* and 12*b*. FIG. 12*a* illustrates a plan view of a piece of fluted microcoil-based cushioning material 20, substantially as in FIG. 11. However, as shown in the cross-sectional view in FIG. 12*b*, in this case the surface cover material 22 extends beyond the region occupied by the microcoil sheet 14. Such an arrangement of the surface cover material 22 relative to the microcoil sheet 14 provides a way of fastening the cushioning material 20 around an underlying structure—in this case, a foam pad 60 and a wooden (e.g. plywood) base 62. More particularly, the surface cover material 22 is stretched around the foam pad 60 and attached to the underside of the wooden base 62 by means of staples 64*a*, 64*b* or tacks.

Cushioning Structures Comprising Conjoined Pieces of Microcoil-Based Cushioning Material As illustrated for example in FIGS. 13*a-c*, 14 and 15*a-c*, cushioning structures may be fabricated comprising a plurality of pieces of microcoil-based cushioning material joined together by means of one or more further seams.

Figure 13A:
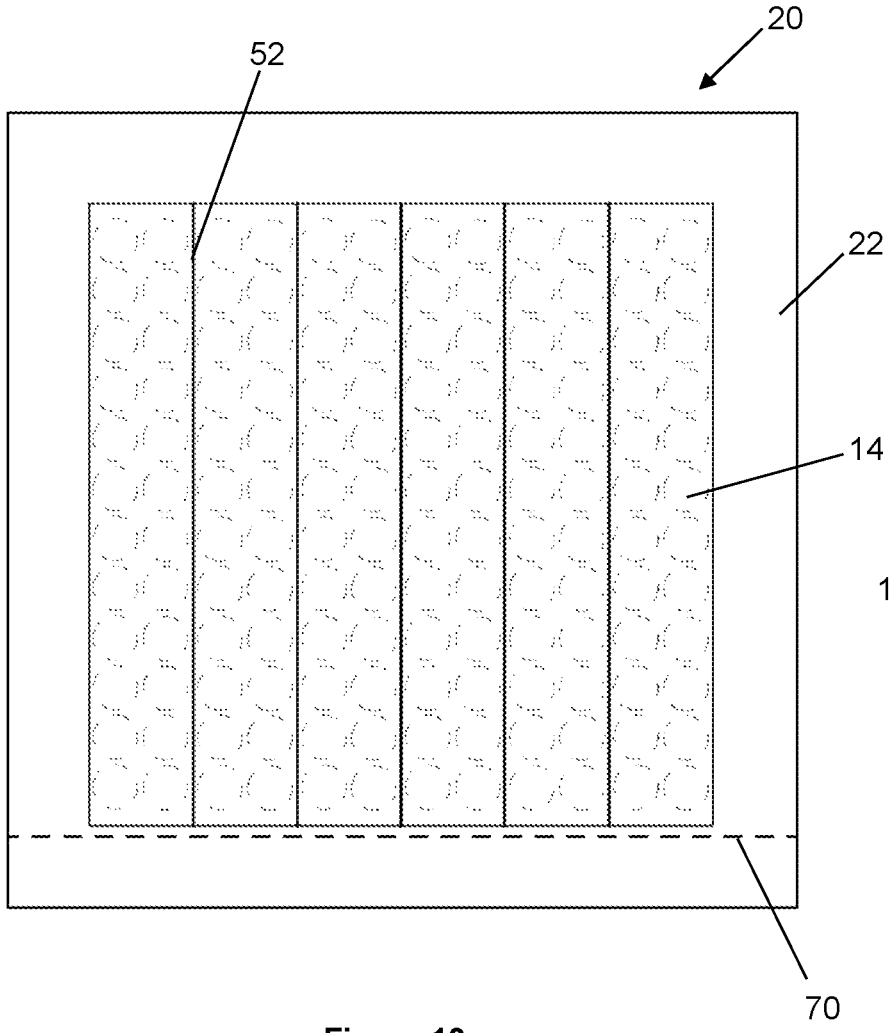
FIGS. 13*a* and 13*b* illustrate plan and cross-sectional views respectively of first and second pieces of fluted microcoil-based cushioning material joined together by means of a further seam.
Figure 13B:
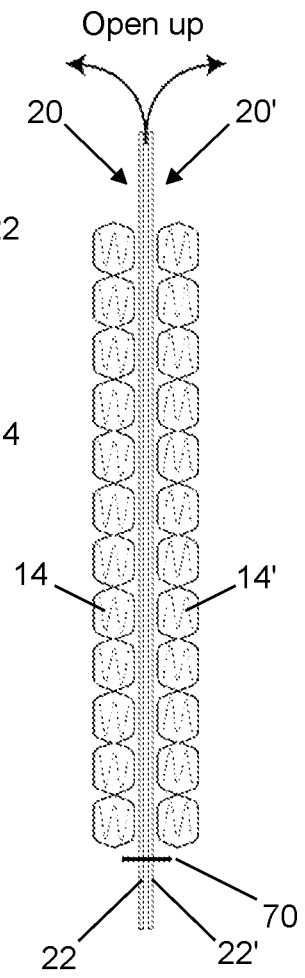
Figure 13C:
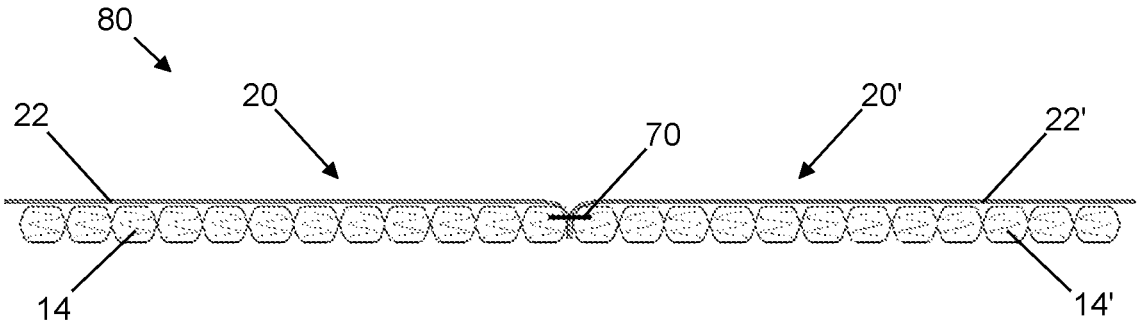
FIG. 13*c* illustrates the joined-together pieces of microcoil-based cushioning material of FIG. 13*b* having been opened-up to lay flat.

FIGS. 13*a* and 13*b* illustrate plan and cross-sectional views respectively of a first piece of fluted microcoil-based cushioning material 20 joined to a second piece of fluted microcoil-based cushioning material 20' by means of a further seam 70, to form a combined cushioning structure 80 as shown in cross-section in FIG. 13*c*.

In more detail, and with particular reference to FIG. 13*b*, the first and second pieces of microcoil-based cushioning material 20, 20' are initially placed back to back, i.e. with the respective pieces of cover material 22, 22' touching each other and the respective microcoil sheets 14, 14' facing outwards. A seam 70 is then sewn (or welded) to join the two pieces of cover material 22, 22' together, beyond one edge of the microcoil sheets 14, 14' (i.e. along one edge of the first and second pieces of cushioning material 20, 20').

The conjoined pieces of microcoil-based cushioning material 20, 20' of FIG. 13*b* are then opened-up (as indicated by the curved arrows) to lay substantially flat, resulting in the combined cushioning structure 80 shown in FIG. 13*c*. It will be appreciated that the seam 70 is hidden from view when the opened-up cushioning structure 80 is viewed from the side of the cover material 22, 22'.

Figure 14:
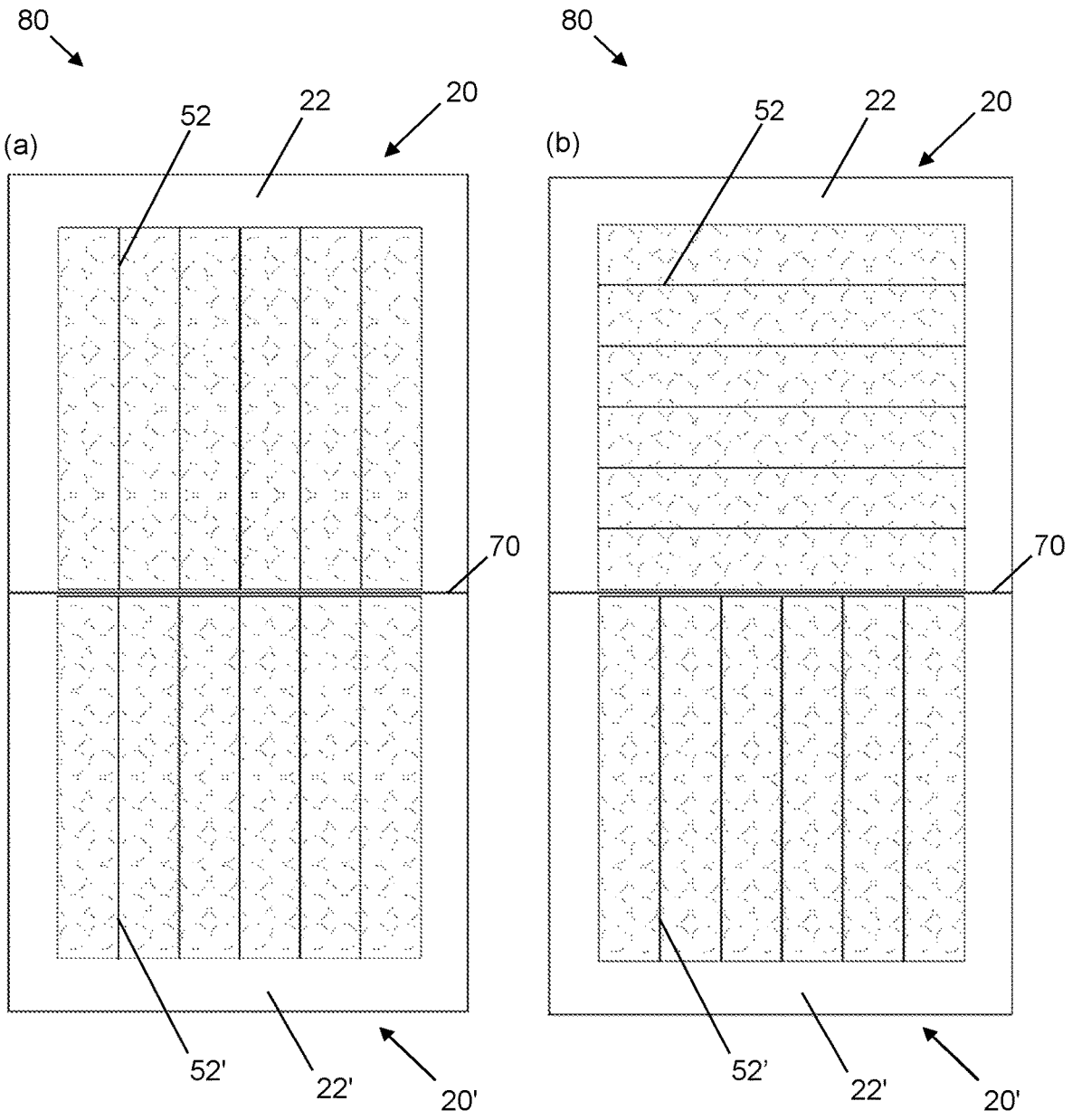
FIG. 14 illustrates plan views of conjoined first and second pieces of fluted microcoil-based cushioning material, with the flutes of the first and second pieces (a) oriented parallel to one another, and (b) oriented perpendicularly to one another.

Such a combined cushioning structure 80 enables the constituent pieces of microcoil-based cushioning material to be selectively configured to suit the desired end product. For instance, as shown in FIG. 14, the flutes of the first and second pieces 20, 20' may be oriented (a) parallel to one another, or (b) perpendicularly to one another, to suit the design and load-supporting/pressure-relieving requirements of the end product. It will of course be appreciated that one or both of the first and second pieces 20, 20' need not be fluted, and could have a different surface design (e.g. that as shown in FIG. 10).

Moreover, the surface cover material 22 and/or microcoil sheet 14 of the first piece of cushioning material 20 may be different from the surface cover material 22' and/or microcoil sheet 14' of the second piece of cushioning material 20', again to suit the design and load-supporting/pressure-relieving requirements of the end product. For example, the surface cover materials 22, 22' could be different fabrics. Alternatively, or in addition, the microcoil sheets 14, 14' could have different properties, e.g. in terms of the stiffness of the springs, the height of the springs, the density of the springs (number of springs per unit area), etc.

Figure 15A:
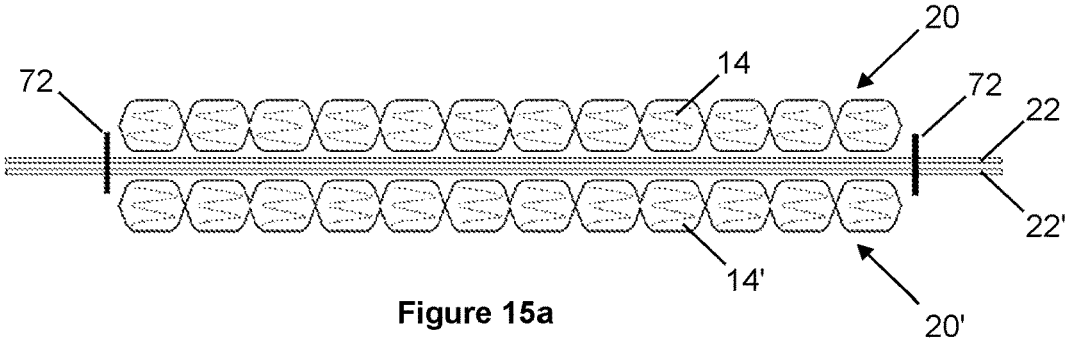
FIGS. 15*a* and 15*b* illustrate cross-sectional and plan views respectively of first and second pieces of fluted microcoil-based cushioning material joined together in an overlaying manner by means of a perimeter seam having an opening on one side, with the microcoil sheets on the outside, to form an intermediate product.
Figure 15B:
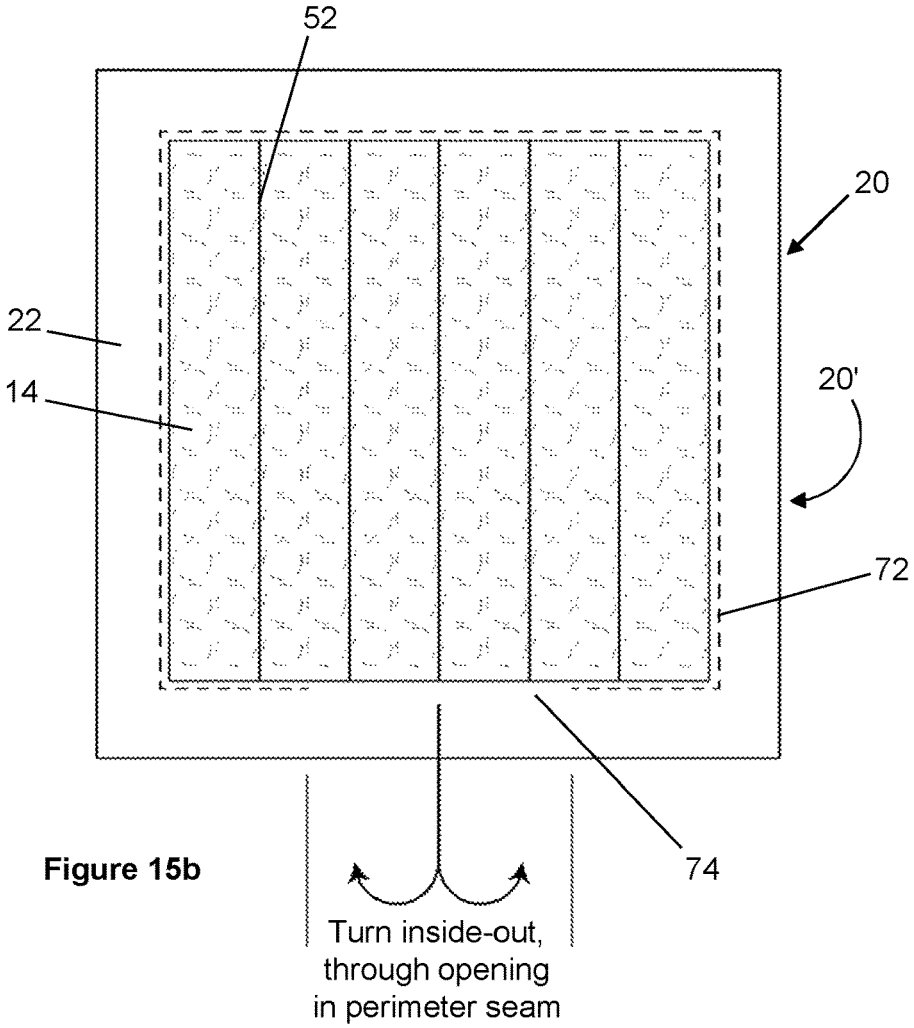
Figure 15C:
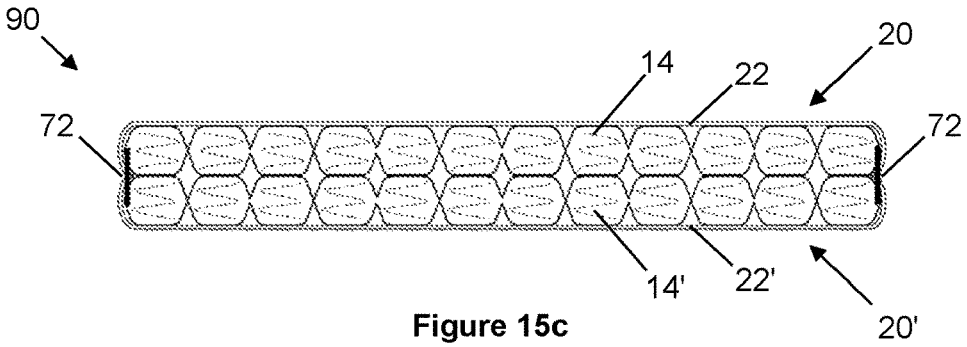
FIG. 15*c* illustrates a cross-sectional view of the intermediate product of FIGS. 15*a* and 15*b* having been turned inside-out, to result in the microcoil sheets of the first and second pieces of cushioning material being on the inside, facing towards one another.

FIGS. 15*a-c* illustrate a further example of a combined cushioning structure comprising first and second pieces of microcoil-based cushioning material 20, 20' joined together in an overlaying manner by means of one or more further seams 72. The resulting cushioning structure 90 is shown in cross-section in FIG. 15*c*, in which the microcoil sheets 14, 14' of the first and second pieces of microcoil-based cushioning material 20, 20' are on the inside of the structure, facing towards one another. Such a cushioning structure 90 may be formed by starting from the configuration shown in FIGS. 15*a* and 15*b*.

More particularly, FIGS. 15*a* and 15*b* illustrate cross-sectional and plan views respectively of a first piece of fluted microcoil-based cushioning material 20 joined to a second piece of fluted microcoil-based cushioning material 20' in a mutually overlaying manner by means of a perimeter seam 72 extending along at least two edges of the first and second pieces of cushioning material 20, 20', beyond the edges of the microcoil sheets 14, 14'. Preferably the perimeter seam 72 is along at least three edges of the overlaying pieces of cushioning material 20, 20', and moreover may be along part (but not all) of a fourth edge, as illustrated. An opening 74 is provided in one edge of the perimeter seam 72, sufficiently large for the "turning inside-out" purpose described below. In the illustrated example the opening 74 in the perimeter seam 72 is approximately one third of the length of the edge of the microcoil sheet 14 therein. Initially, as shown in FIG. 15*a*, when the first and second pieces of cushioning material 20, 20' are joined together by means of the perimeter seam 72, the microcoil sheets 14, 14' are on the outside of the structure, facing away from one another. The structure of FIG. 15*a* may be considered to be an "intermediate product".

With reference to FIGS. 15*b* and 15*c*, the above "intermediate product" is then turned inside-out, through the opening 74 in the perimeter seam 72, to result in the structure 90 of FIG. 15*c* in which the microcoil sheets 14, 14' of the first and second pieces of cushioning material 20, 20' face towards one another. By virtue of this method of manufacture, the microcoil sheets 14, 14' and the perimeter seam 72 are hidden from view once the cushioning structure 90 has been formed.

The structure 90 encapsulates the microcoil sheets 14, 14' and can be used as a standalone pillow or cushion, or may be attached to a frame or other structure. Moreover, by virtue of the microcoil sheets 14, 14' acting against each other whilst not being particularly constrained laterally (thus allowing the springs a high degree of mobility), the resulting cushioning structure 90 is able to provide a high level of pressure relief.

Figure 12B:
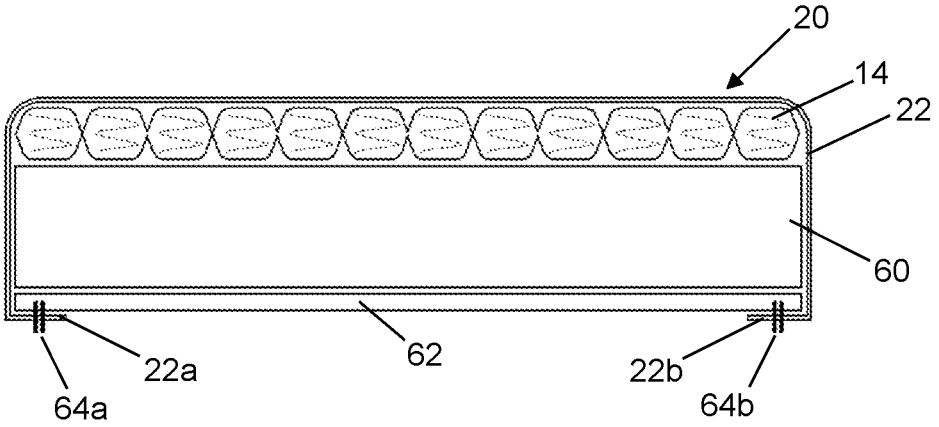
FIG. 12*b* illustrates a cross-sectional side view of the microcoil-based cushioning material of FIG. 12*a* stretched around a foam pad and fastened to a wooden base.

The cushioning structure 90 of FIG. 15*c* represents an improvement in spring mobility compared to "fixed" upholstery of the kind illustrated in FIG. 12*b*, where the surface cover material 22 of the cushioning material 20 is stapled or tacked down onto a wooden base 62. A problem with such "fixed" upholstery is that the cushioning unit has less mobility, which is key to the pressure-relieving performance of the product. For instance, with reference to FIG. 12*b*, the fabric of the cover material 22 may be pulled tight to reduce gathered fabric and pleats, and for general quality, but this tension reduces movement of the springs of the microcoil sheet 14, even if a knitted fabric with two-way stretch is used. The foam pad 60 may also grip the springs of the microcoil sheet 14, reducing movement further. The cushioning structure 90 of FIG. 15*c* solves these problems, by embodying the present invention in effectively a loose cushion. This greatly improves the freedom of movement of the springs of the microcoil sheets 14, 14', allowing them to fully conform to the user's body rather than be constrained by the wooden base 62. Far greater immersion of the user into the product is therefore possible. The combination of greater immersion and greater contact area, together with the ability of the microcoil sheets 14, 14' and constituent springs to move and conform to the user's body, results in significantly lower peak pressures.

The enclosed cushioning structure 90 as a standalone product may be used as for pressure-relieving cushions for seats (e.g. wheelchairs, vehicles seats, office chairs, etc.), bed mattresses, mattress toppers or weighted blankets.

If desired, the cushioning structure 90 may be modified by providing an insert between the microcoil sheet 14 of the first piece of cushioning material 20 and the microcoil sheet 14' of the second piece of cushioning material 20'. The insert may comprise one or more of:

- sheet foam or moulded foam (to alter the thicknesses of the structure 90 and create profiling);
- a rigid or semi-rigid former (to provide focused support, e.g. to the user's lower spine in seating—the position of such a former may be adjustable);
- one or more structural members that form part of the structure of an item of furniture (e.g. a tubular backrest frame);
- heating elements, or vibration or massage elements;
- one or more fixing structures or mounts (by which the cushioning structure 90 may be attached to an item of furniture); or
- another (i.e. third) microcoil sheet.

When introducing the third microcoil sheet between the existing microcoil sheets 14, 14', the third sheet may for example be stitched onto either of the existing microcoil sheets 14, 14' along its edges. This would give the user greater immersion in regions of a backrest, for example. If a third microcoil sheet with stronger (i.e. stiffer) springs were to be used, this would give more support to those regions of the backrest too.

The invention claimed is:

1. A method of manufacturing cushioning material comprising a prefabricated microcoil sheet and a surface cover material, comprising:

obtaining a prefabricated commercially-available microcoil pocketed spring sheet comprising an array of wire springs held between two layers of fabric, the layers of fabric having been joined together by weld lines between said springs during prefabrication of the microcoil pocketed spring sheet, to form discrete spring containing pockets; and then fastening the cover material to the microcoil-pocketed spring sheet by one or more seams;

wherein the seams are formed by machine needle-and-thread sewing, the machine needle-and-thread sewing passing through the cover material and the microcoil pocketed spring sheet; and wherein the seams are substantially congruent with weld lines of the microcoil pocketed spring sheet, between said springs of the microcoil pocketed spring sheet.

2. The method according to claim 1, further comprising providing an interlayer material between the cover material and the microcoil pocketed spring sheet, the machine needle-and-thread sewing also passes through the interlayer material.

3. The method according to claim 1, wherein the seams define, in the cover material, elongate flutes that separate groups of springs, and wherein, when forming each seam, the cover material is first folded to form a double-layer of the cover material, then said double-layer of the cover material is fastened to the microcoil pocketed spring sheet to form the seam.

4. The method according to claim 1, wherein the seams run continuously across the cushioning material.

5. The method according to claim 1, wherein the seams are discontinuous across the cushioning material.

6. The method according to claim 5, wherein the seams are in the form of cross stiches coinciding with intersections of the weld lines of the microcoil pocketed spring sheet.

7. The method according to claim 1, wherein the cover material is directly in contact with the microcoil pocketed spring sheet.

8. The method according to claim 1, wherein the seams define, in the cover material, pockets that separate individual springs or groups of springs.

9. A method of manufacturing cushioning material comprising a prefabricated microcoil sheet and a surface cover material, comprising:

obtaining a prefabricated commercially-available microcoil pocketed spring sheet comprising an array of wire springs held between two layers of fabric, the layers of fabric having been joined together by weld lines between said springs during prefabrication of the microcoil pocketed spring sheet, to form discrete spring containing pockets; and then fastening the cover material to the microcoil-pocketed spring sheet by one or more seams;

wherein the seams are formed by machine needle-and-thread sewing, the machine needle-and-thread sewing passing through the cover material and the microcoil pocketed spring sheet; and wherein the seams extend along weld lines of the microcoil pocketed spring sheet, between said springs of the microcoil pocketed spring sheet.

10. The method according to claim 9, further comprising providing an interlayer material between the cover material and the microcoil pocketed spring sheet, the machine needle-and-thread sewing also passes through the interlayer material.

11. The method according to claim 9, wherein the seams define, in the cover material, elongate flutes that separate groups of springs, and wherein, when forming each seam, the cover material is first folded to form a double-layer of the cover material, then said double-layer of the cover material is fastened to the microcoil pocketed spring sheet to form the seam.

12. The method according to claim 9, wherein the seams run continuously across the cushioning material.

13. The method according to claim 9, wherein the seams are discontinuous across the cushioning material.

14. The method according to claim 13, wherein the seams are in the form of cross stiches coinciding with intersections of the weld lines of the microcoil pocketed spring sheet.

15. The method according to claim 9, wherein the cover material is directly in contact with the microcoil pocketed spring sheet.

16. The method according to claim 9, wherein the seams define, in the cover material, pockets that separate individual springs or groups of springs.

* * * * *